US006205682B1

(12) United States Patent
Park

(10) Patent No.: US 6,205,682 B1
(45) Date of Patent: Mar. 27, 2001

(54) AIR CUSHION HAVING SUPPORT PIN STRUCTURE FOR SHOCK-ABSORBING, METHOD FOR MANUFACTURING THE AIR CUSHION, AND FOOTGEAR COMPRISING THE AIR CUSHION

(75) Inventor: Jong-Yeong Park, Kyungnam Sunkyung Apt. 116-601 1448, Chwa-dong, Haeundae-gu, Pusan (KR)

(73) Assignees: Jong-Yeong Park, Pusan; Soo-Dong Yang, Kimhea, both of (KR)

( * ) Notice: Subject to any disclaimer, the term of this patent is extended or adjusted under 35 U.S.C. 154(b) by 0 days.

(21) Appl. No.: 09/413,988

(22) Filed: Oct. 7, 1999

(30) Foreign Application Priority Data

Sep. 17, 1999 (KR) ..... 99-40122

(51) Int. Cl.[7] ..... A43B 13/18
(52) U.S. Cl. ..... 36/29; 36/37; 36/28; 36/71
(58) Field of Search ..... 36/28, 29, 71, 36/37, 35 B, 35 R, 3 R; 12/146 R, 146 B, 142 P

(56) References Cited

U.S. PATENT DOCUMENTS 5,174,049 * 12/1992 Flemming ..... 36/28
5,197,207 * 3/1993 Shorten ..... 36/29
5,331,750 * 7/1994 Sasaki et al. ..... 36/28
5,369,896 * 12/1994 Frachey et al. ..... 36/28
5,771,611 * 6/1998 Chang ..... 36/29
5,915,819 * 6/1999 Gooding ..... 36/29
5,993,585 * 11/1999 Goodwin et al. ..... 36/29

* cited by examiner

*Primary Examiner*—M. D. Patterson
(74) *Attorney, Agent, or Firm*—McCormick, Paulding & Huber LLP

(57) ABSTRACT

Disclosed is an air cushion having a support pin structure for absorbing shock, a method for manufacturing the air cushion, and footgear comprising the air cushion which does not exhibit any bulging effect, even upon application of an external pressure, to thereby improve the stability thereof. The air cushion includes: an upper plate having a plurality of support pins arranged at the same height or different height in a downward direction on the bottom surface thereof; a lower plate having a plurality of pin receiving bodies on the top surface thereof opposite to the upper plate, each of the pin receiving bodies having a groove into which each of the support pins is inserted; and a cushion body adapted to surround the coupled state of the upper plate with the lower plate where the support pins are received and fixed into the pin receiving bodies, thereby maintaining the air-tightness therein.

14 Claims, 12 Drawing Sheets

FIG. 8
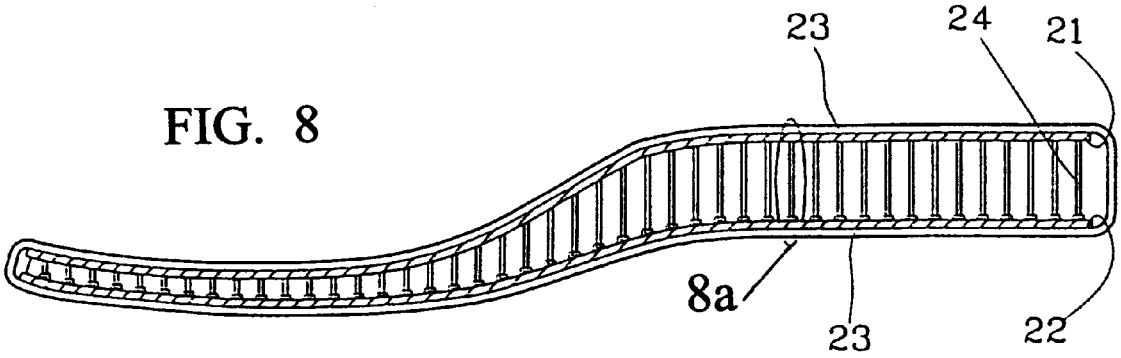
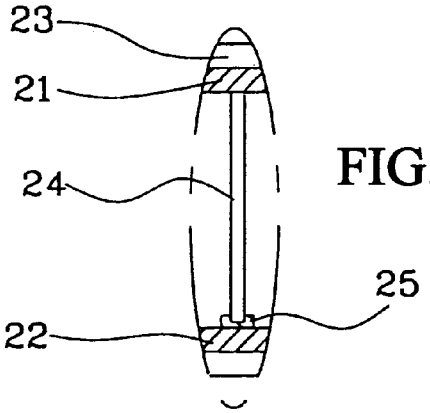
FIG. 8a

AIR CUSHION HAVING SUPPORT PIN STRUCTURE FOR SHOCK-ABSORBING, METHOD FOR MANUFACTURING THE AIR CUSHION, AND FOOTGEAR COMPRISING THE AIR CUSHION

BACKGROUND OF THE INVENTION

1. Field of the Invention

The present invention relates to an air cushion having a support pin structure for absorbing shock, a method for manufacturing the air cushion, and footgear comprising the air cushion.

More particularly, the present invention relates to an air cushion having a support pin structure for absorbing shock, a method for manufacturing the air cushion, and footgear comprising the air cushion which do not exhibit any bulging effect, even upon application of an external pressure, to thereby improve the stability thereof.

2. Discussion of Related Art

As well known, feet of a human being have some functions of supporting his or her body weight by the contact onto the ground upon an upright position and executing walking or exercise with an appropriate movement. Mostly, the sole of a normal foot is in contact with the ground except for a vaulted portion thereof, upon the upright position, to thereby take a stable upright position. In addition, the vaulted portion of the sole of foot is extracted like a spring, upon walking or running, to thereby absorb the shock applied onto the foot. Moreover, the vaulted portion of the sole of foot makes the front portion of the foot comprised of toes in a free-movement state, to thereby execute a light and smooth walking or running. It is therefore desirable to select footgear which allows the sole of foot to be in contact with the ground to thereby distribute the load applied thereto.

For instance, generally, during a sportsman takes exercise such as running, basketball, football, tennis and the like, a great amount of shock is applied onto his foot in a continuous and repetitive manner and, whenever the foot is in contact into the ground, is directly transmitted to the foot. At this time, his foot during the exercise can absorb the shock applied, while supporting his body weight, but since the amount of the shock applied corresponds to several times as much as his body weight, the cartilaginous portion of the foot is likely to be weakened, which will be easily exposed to damage or aging.

Therefore, it is very important for a sportsman or a general person to select footgear which can completely absorb an amount of shock applied.

For this end, various kinds of conventional cushions for absorbing the shock are mounted in the footgear, specifically sports shoes.

The footgear inclusive of the sports shoes is comprised of a sole having a laminated form of an outsole, a midsole and an insole, and an outer surface attached on the sole to surround the foot. In this case, a shock absorbing material is typically disposed on the sole of the footgear.

By way of example, a conventional cushion for shock-absorbing in an initial developing step is made of a general elastic material such as, for example, rubber, sponge, polyurethane foam, etc. In more detail, the elastic material is processed to a plate shape and attached between the outsole and the midsole or between the midsole and the insole, such that it can absorb the shock applied to the sole of foot, while supporting the sole of foot. However, the conventional air cushion fails to completely absorb the large amount of shock corresponding to hundreds of kilograms to tens of tons. Unfortunately, moreover, upon the application of a tremendous amount of shock the cushion is under a permanently deformed state, which does not exert any absorbing performance.

On the other hand, another shock absorbing material has been developed, in which a flow type material in a liquid or semi-solid type (i.e., gel) is enveloped in a sealing body made of an elastic material. However, since most of the flow type material is incompressible, it fails to completely absorb the shock applied onto the shock absorbing body in the same manner as the above.

Recently, an air cushion as a shock-absorbing material is developed and widely used in sports shoes, etc.

The sports shoe having a conventional air cushion is shown in FIGS. 1 and 2. The air cushion is comprised of an upper plate 11, a lower plate 12, and a side plate 13. In this case, the upper and lower plates 11 and 12 are made of a flexible material and separated at a predetermined interval to be faced in parallel to each other. The side plate 13 is made of the same flexible material and is melting-attached to the upper plate 11 to maintain the air-tightness along the edge of the upper plate 11, at the top portion thereof. At this time, the melting attachment utilizes a conventional method such as an ultrasonic melting. Under the above construction, the sealing of the upper plate 11, the lower plate 12, and the side plate 13 forms a cavity in the interior thereof, into which air for shock-absorbing fills to exert the shock absorbing performance, whenever a predetermined shock is applied to the air cushion. As shown in FIGS. 1 and 2, the air cushion is secured on an outsole 2, and an outer surface 3 is attached on the outsole 2, such that in the shoe where the foot is received by means of the outer surface 3, the air cushion is disposed in the midsole on the rear portion of the shoe, that is, the direct lower portions of the sole of foot and the heel of the foot. The air filling the interior of the air cushion is compressed, such that it can fully absorb and buffer the shock force generated when the load of the user of the shoe is applied to the lower side. In this case, during the user of the shoe takes the exercise, the amount of shock generated due to the load of the user's body weight is transmitted to the shoe, whenever the shoe is in contact with the ground. Generally, as the amount of shock is primarily collected to the heel of the shoe and is then moved to the front portion of the shoe, the pressure of air is applied even to the front portion thereof. The shock force applied to the shoe is buffered by the buffering action through the air compression in the air cushion. At this time, if the shock is applied to a part of the upper plate 11, the part of the upper plate 11 (hereinafter, referred to simply 'a compressed portion') is pushed and compressed, to thereby execute a primary buffering performance. Concurrently, however, the interval between the upper plate 11 and the lower plate 12 is reduced on the compressed portion, and the air is collected on the portion (hereinafter, referred to simply 'an non-compressed portion') where no push or compression is generated, to thereby form a strong air pressure. Thereby, the formation of air pressure causes the non-compressed portion to be expanded. Hereinafter, this phenomenon refers to 'a bulging effect' in this specification. In case of such the conventional air cushion, there is a problem that a bulging effect is exhibited whenever shock is applied, as shown in FIG. 3. As a result, when the upper plate 11 and the lower plate 12 on the non-compressed portion expanded due to the bulging effect are restored in their original positions, they are likely to momentarily fail to be in the position of their original height due to the inertial force, which results in the formation of a curved surface. This bulging effect continues until the air pressure due to the shock force is somewhat removed, that is, the shock force cannot further deforms the upper plate 11, the lower plate 12 and the side plate 13. Moreover, since the bulging effect occurs on the several portions of the air cushion in continuous and repetitive manners all the time during the user takes the exercise, the curved surface is continuously generated, deformed and removed, in the state where the upper and lower plates 11 and 12 of the air cushion do not maintain the flat surface. However, there still occur problems that the conventional air cushion does not exert an excellent shock-absorbing performance and gives somewhat inconvenience to the user upon wearing.

Also, there has been recently developed an air cushion having a support thread structure between the upper and lower plates 11 and 12 to reduce the bulging effect, as shown in FIGS. 4 and 5. In construction, the support thread 14 is adapted to connect the upper and lower plates 11 and 12, as shown in FIGS. 6 and 7. When the upper and lower plates 11 and 12 are woven into a plain fabric where the warp and woof threads are woven, the support thread 14 becomes a loop thread for the warp threads for weaving the upper and lower plates 11 and 12, such that it secures the upper and lower plates 11 and 12 against each other, while maintaining an air chamber having a predetermined interval between the woven upper and lower plates 11 and 12. At this time, the support thread 14 is comprised of a typical synthetic fiber or a metal wire. The upper and lower plates 11 and 12 are woven into double fabrics and are secured to each other by means of the side plate 13. Furthermore, the upper and lower plates 11 and 12 form a coating layer on the outer surface thereof to thereby maintain the air-tightness therebetween. Otherwise, the upper and lower plates 11 and 12 are closely attached and secured on the inner side of a cushion body 23 constituting the side plate 13. The cushion body 23 is formed by a thermoplastic polyurethane which is adequate to maintain the air-tightness therein, thereby preventing controlling the discharge of air filling in the interior thereof.

Therefore, the compression is formed by the curving of the support thread 14 on the compressed portion of the upper plate 11, but the expansion is not formed over the length in a height direction of the support thread 14 on the non-compressed portion thereof, unless the support thread 14 is cut. As a result, the support thread 14 functions to suppress the formation of the curved surfaces on the upper and lower plates 11 and 12. But since the support thread 14 is woven into the loop fabric, the height of the support thread 14 is not adaptively controlled. Therefore, there occurs a problem that all of the upper and lower plates 11 and 12 have a flat structure. This is because the formation of support thread 14 is dependent upon a weaving manner. However, the air cushion having the flat structure is not well matched with the sole of foot having the curved surface, such that it is covered not over the whole sole of foot, but only on a predetermined portion thereof. Therefore, there occurs a problem that the air cushion does not exhibit a complete shock absorbing performance over the whole sole of foot. As the sole of foot takes a three-dimensional shape, the air cushion constructed as the above fails to provide a satisfied buffering effect and a convenient wearing feeling to the user. Hence, there is a need to develop a novel air cushion for completely absorbing shock.

SUMMARY OF THE INVENTION

Accordingly, the present invention is directed to an air cushion having a support pin structure for absorbing shock, a method for manufacturing the air cushion, and footgear comprising the air cushion that substantially obviates one or more of the problems due to limitations and disadvantages of the related arts.

An object of the invention is to provide an air cushion having a support pin structure for absorbing shock which does not exhibit any bulging effect, even upon application of an external pressure, to thereby improve the stability thereof.

Another object of the invention is to provide a method for manufacturing an air cushion having a support pin structure for absorbing shock which does not exhibit any bulging effect, even upon application of an external pressure, to thereby improve the stability thereof.

Still another object of the invention is to provide footgear comprising an air cushion having a support pin structure for absorbing shock which does not exhibit any bulging effect, even upon application of an external pressure, to thereby improve the stability thereof.

Yet another object of the invention is to provide footgear which transmits an external pressure uniformly over the whole sole of a foot to thereby protect a user's physical portion where injury easily occurs, for example, a foot's joint, an ankle, etc.

According to an aspect of the present invention, there is provided an air cushion having a support pin structure for absorbing shock, including: an upper plate having a plurality of support pins arranged at the same height or different height in a downward direction on the bottom surface thereof; a lower plate having a plurality of pin receiving bodies on the top surface thereof opposite to the upper plate, each of the pin receiving bodies having a groove into which each of the support pins is inserted; and a cushion body adapted to surround the coupled state of the upper plate with the lower plate where the support pins are received and fixed into the pin receiving bodies, thereby maintaining the air-tightness therein.

According to another aspect of the present invention, there is provided a method for manufacturing an air cushion having a support pin structure for absorbing shock, including the steps of: molding an upper plate having a plurality of support pins arranged at the same height or different height in a downward direction on the bottom surface thereof by means of a mold in an injection or compression molding manner; molding a lower plate having a plurality of pin receiving bodies on the top surface thereof opposite to the upper plate by means of a mold in the injection or compression molding manner, each of the pin receiving bodies having a groove into which each of the support pins is inserted; coupling the upper plate with the lower plate to receive and fix the support pins into the pin receiving bodies; and sealing the coupled upper and lower plates by means of a cushion body to maintain the air-tightness therein.

According to still another aspect of the present invention, there is provided footgear comprising an air cushion having a support pin structure for absorbing shock is characterized in that said support pin structure comprises an upper plate having a plurality of support pins arranged at the same height or different height in a downward direction on the bottom surface thereof, a lower plate having a plurality of pin receiving bodies on the top surface thereof opposite to the upper plate, each of the pin receiving bodies having a groove into which each of the support pins is inserted, and a cushion body adapted to surround the coupled state of the upper plate with the lower plate where the support pins are received and fixed into the pin receiving bodies, thereby maintaining the air-tightness therein, whereby the air cushion having the support pin structure is manufactured to take a corresponding shape to the whole sole of foot like an insole thereof, which is laminated together with an outsole and a midsole and is finally attached to an outer surface.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings.

Figure 1:
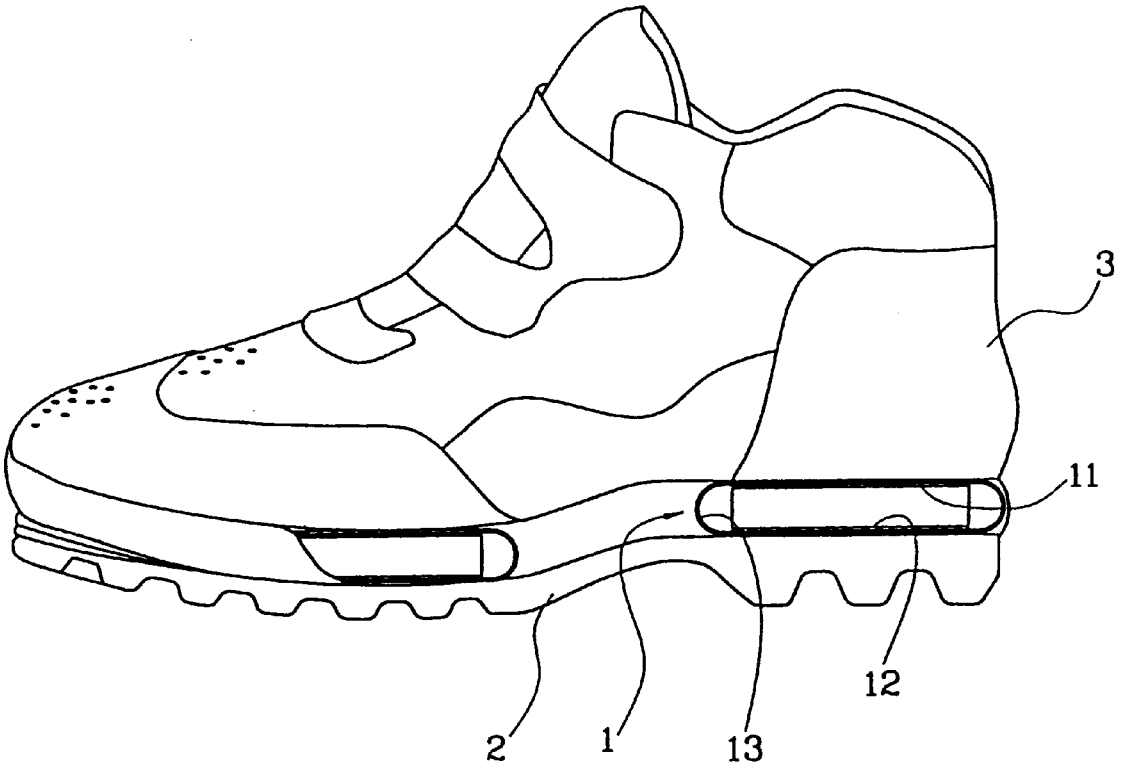
FIG. 1 PRIOR ART
FIG. 1 is a perspective view, partly in section, showing a conventional footgear in which an air cushion for shock-absorbing is mounted.
Figure 2:
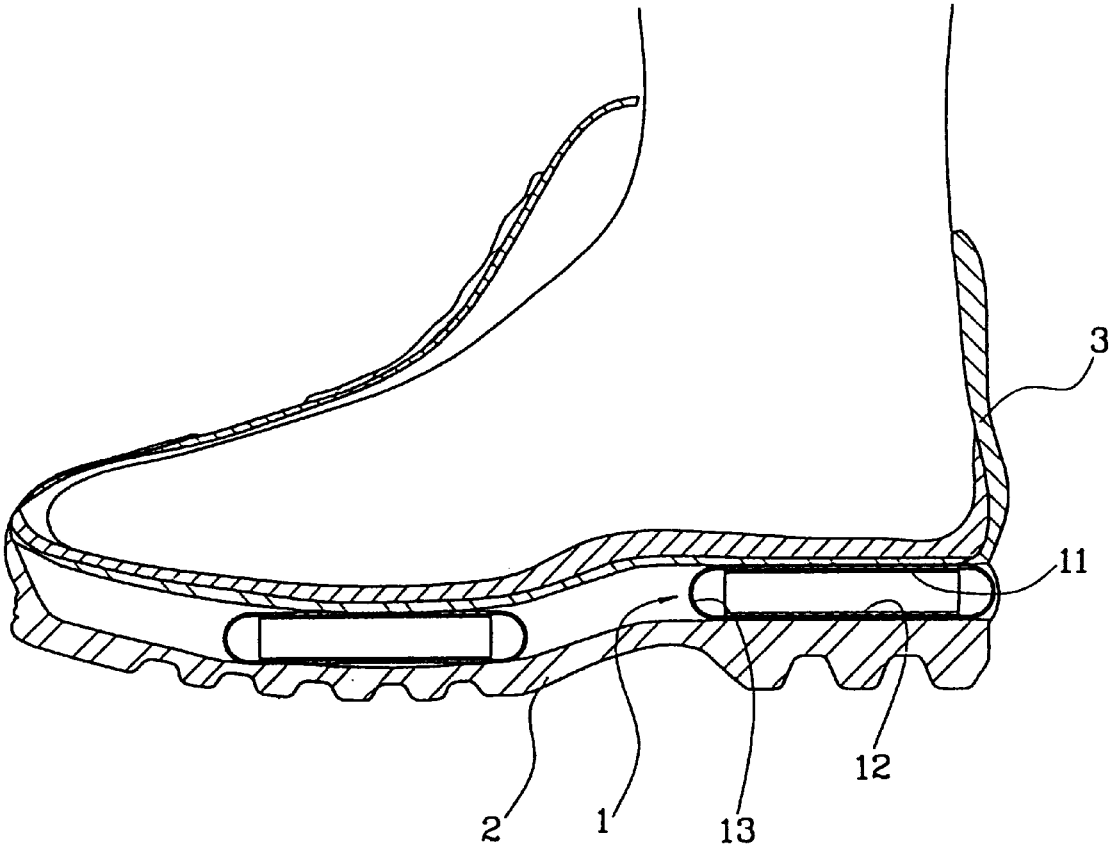
FIG. 2 PRIOR ART
FIG. 2 is a side sectional view of FIG. 1.
Figure 3:
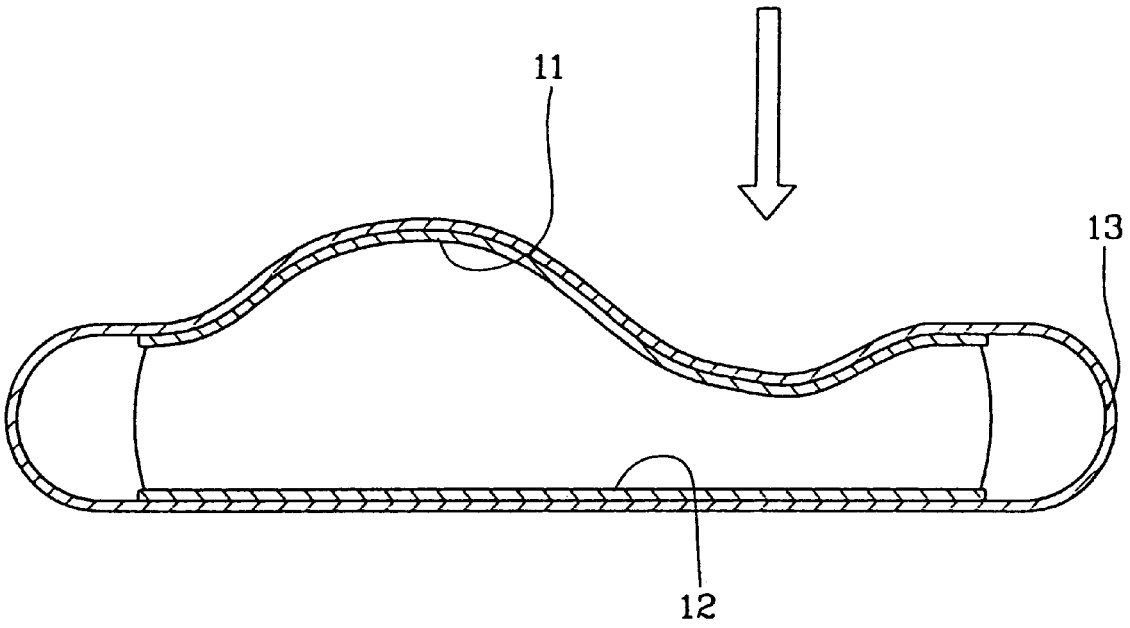
FIG. 3 PRIOR ART
FIG. 3 is a side sectional view showing the transformed state of the air cushion upon the application of shock onto the air cushion of FIG. 1.
Figure 4:
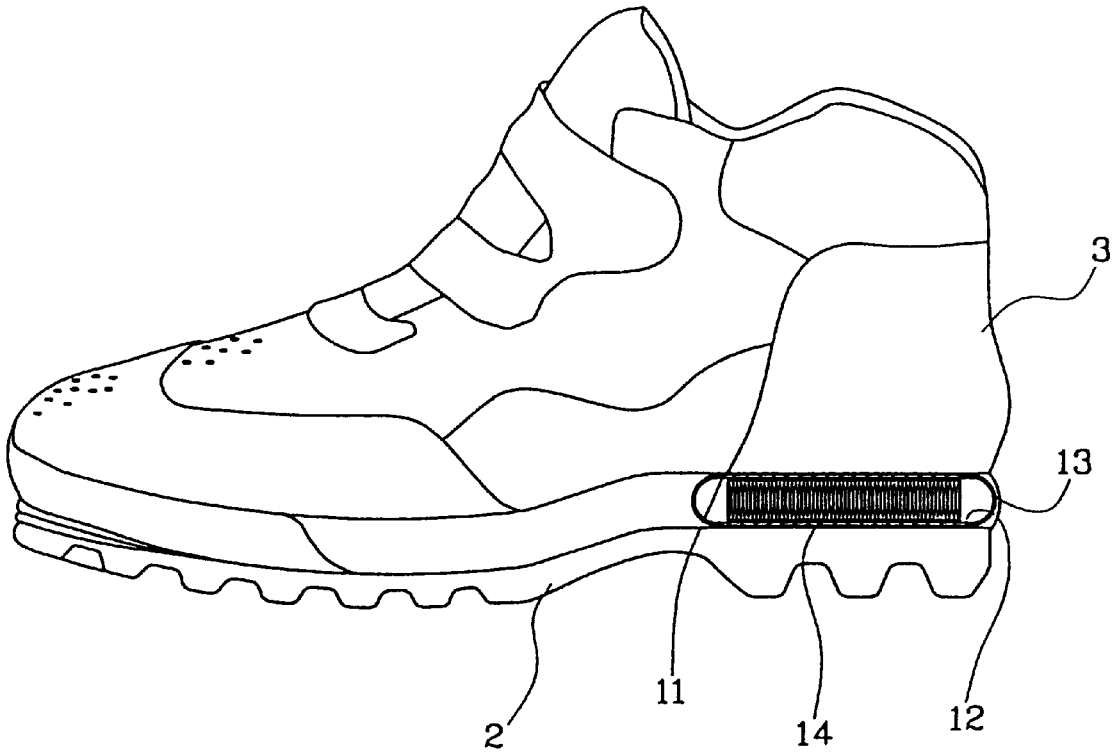
FIG. 4 PRIOR ART
FIG. 4 is a perspective view, partly in section, showing another conventional footgear in which an air cushion having a support thread structure for shock-absorbing is mounted.
Figure 5:
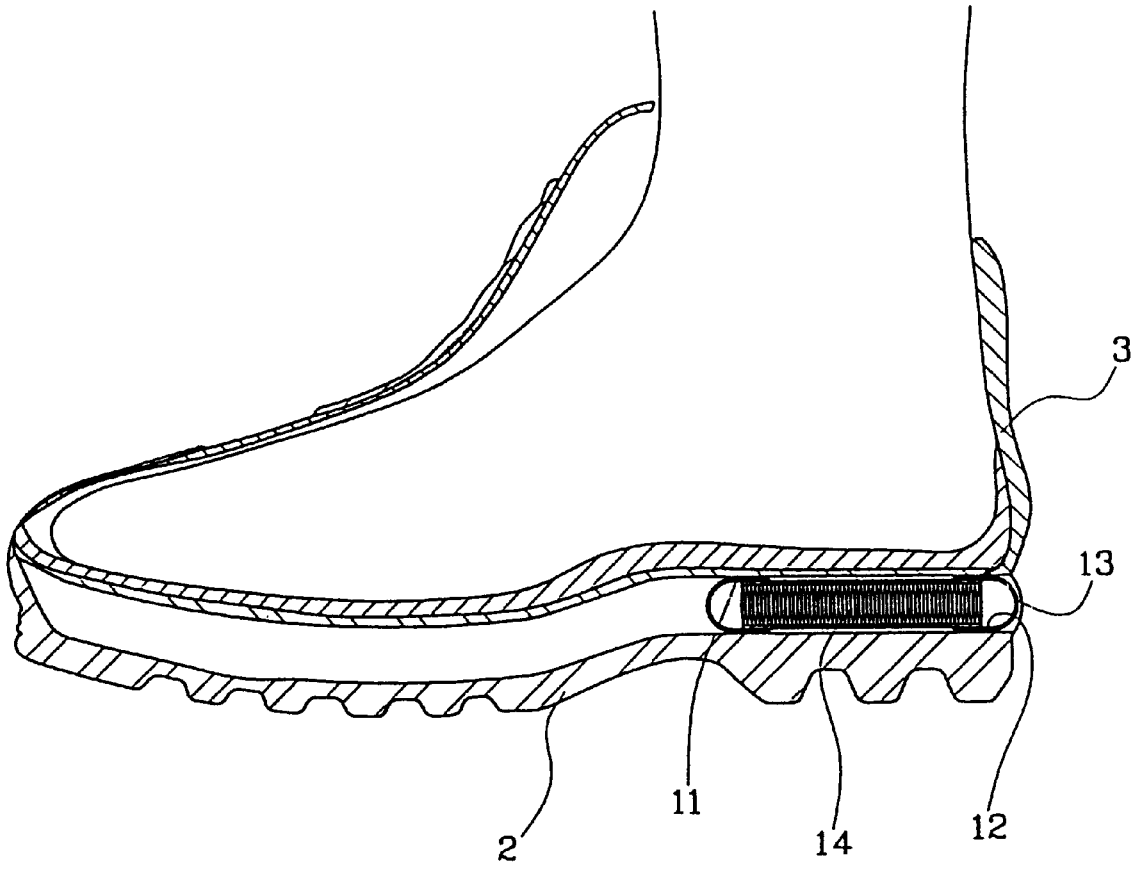
FIG. 5 PRIOR ART
FIG. 5 is a side sectional view of FIG. 4.
Figure 6:
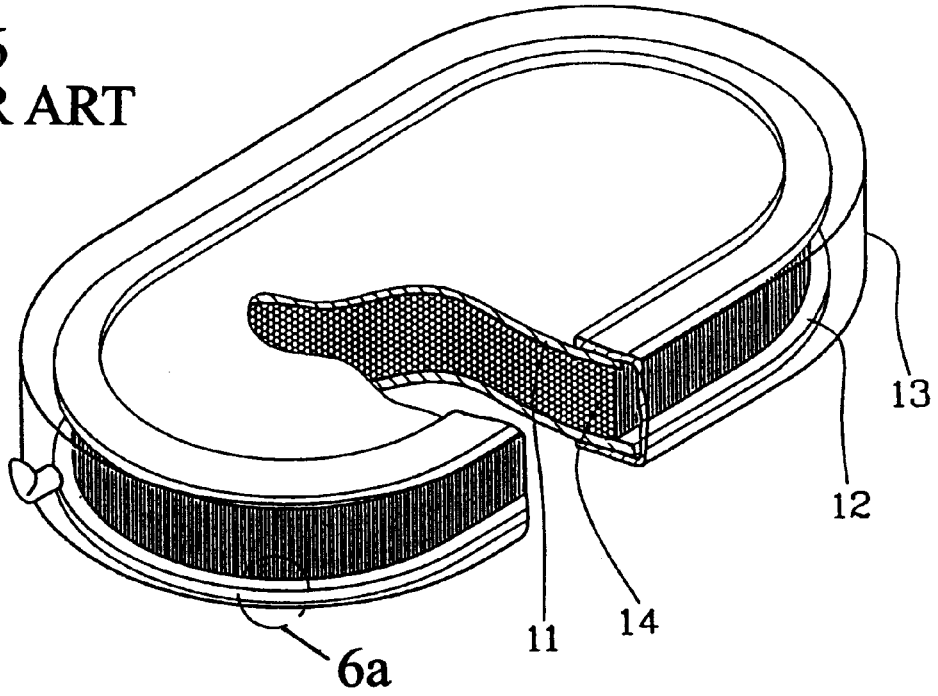
FIG. 6 PRIOR ART
FIG. 6 is a perspective view, partly in section, showing the air cushion having the support thread structure of FIG. 4.
Figure 6A:
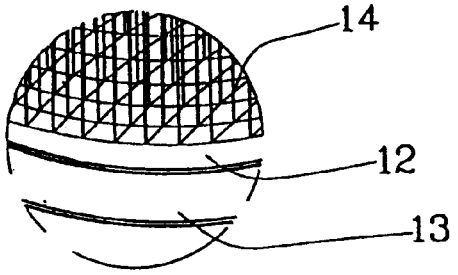
FIG. 6a PRIOR ART
Figure 7A:
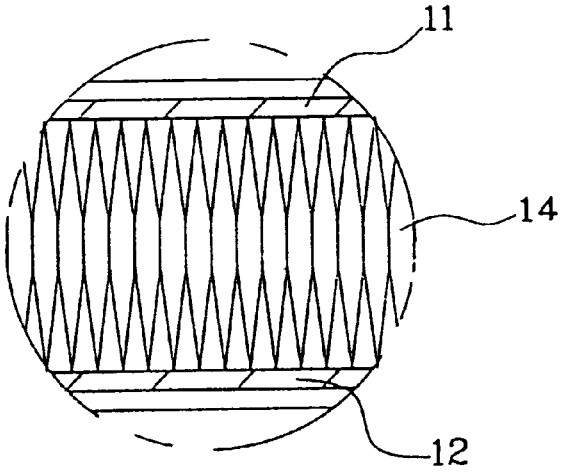
FIG. 7a PRIOR ART
Figure 7:
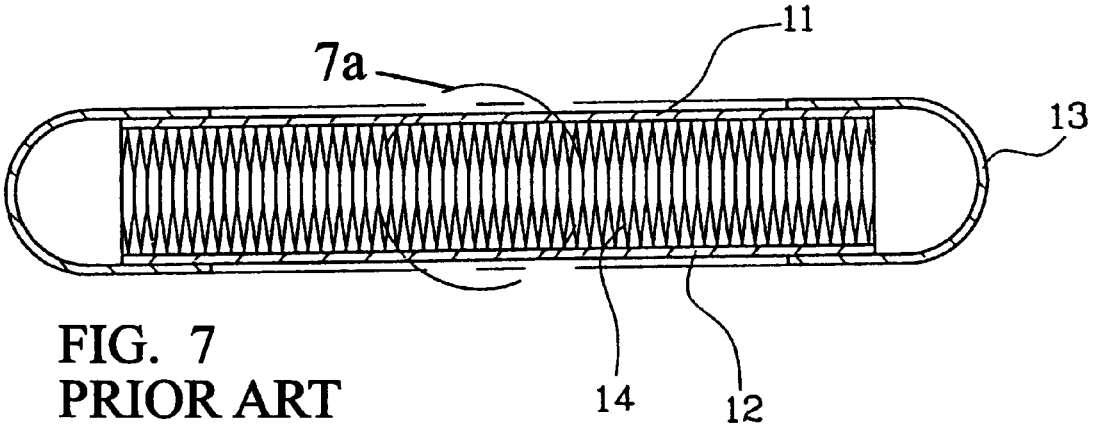
FIG. 7 PRIOR ART
Figure 9:
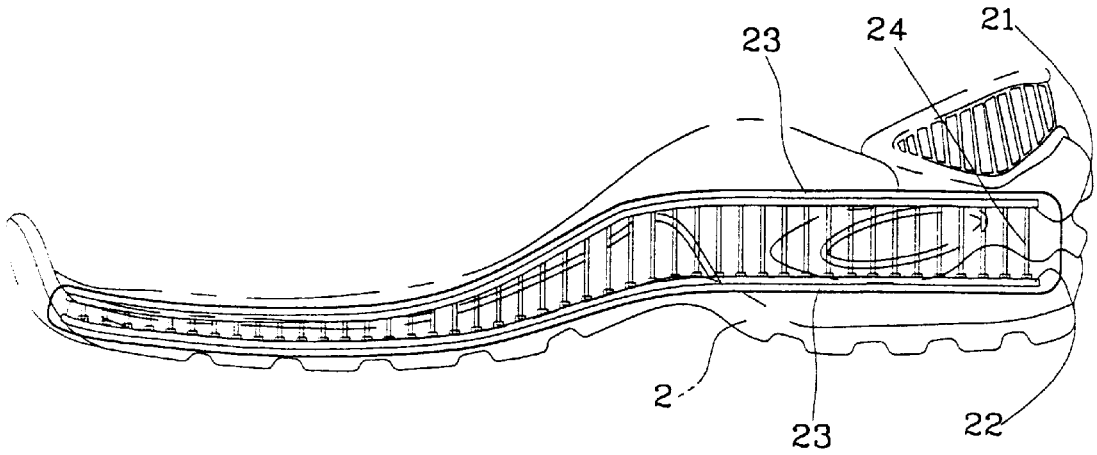
Figure 10:
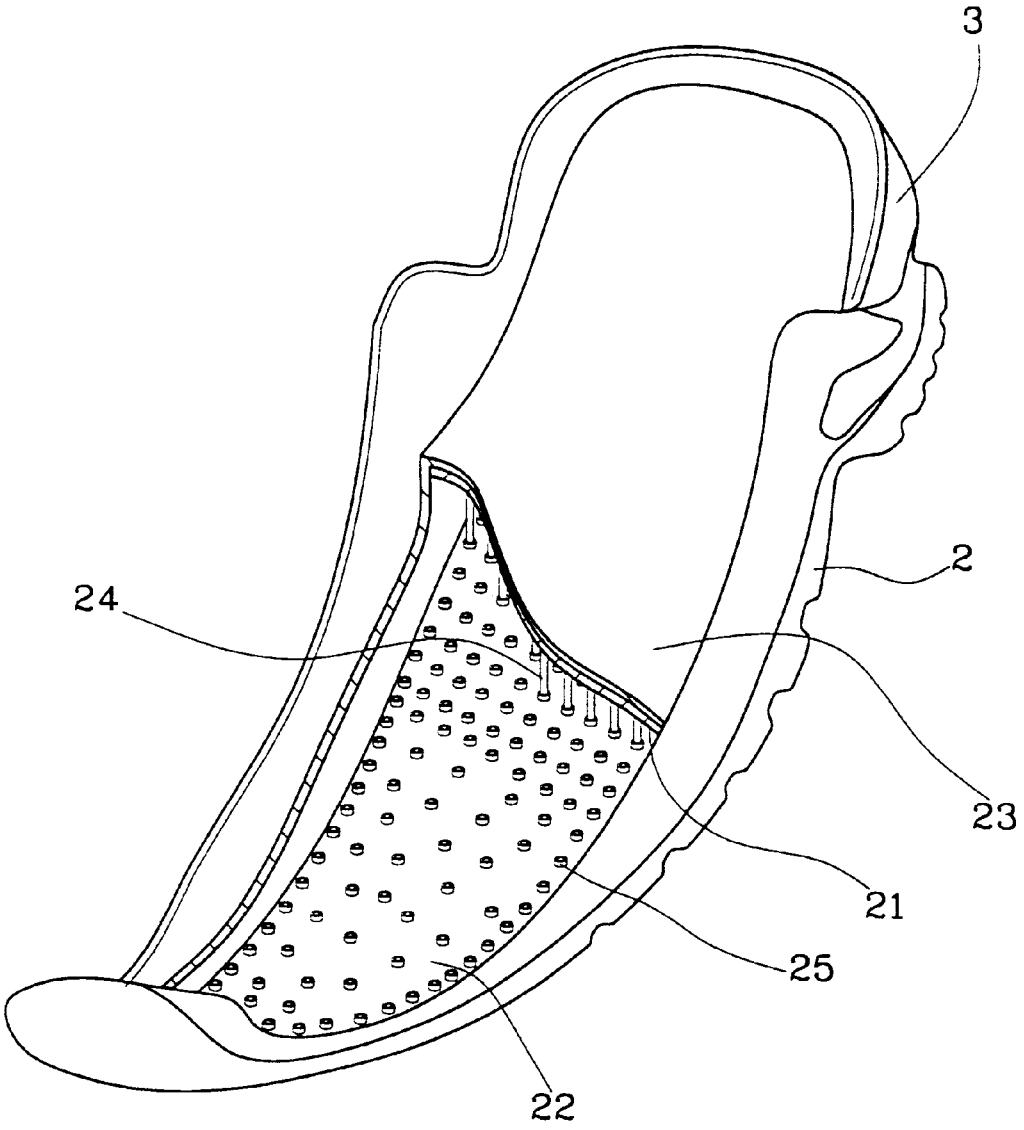

FIG. 6*a* is a blown up perspective view of the area labeled 6*a* of FIG. 6;

FIG. 7 is a side sectional view showing the air cushion of FIG. 4;

FIG. 7*a* is a blown up side sectional view of the area labeled 7*a* of FIG. 7;

FIG. 8 is a side sectional view showing an air cushion having a support pin structure for shock-absorbing constructed according to an embodiment of the present invention;

FIG. 8*a* is a blown up side sectional view of the area labeled 8*a* of FIG. 8;

FIG. 9 is a side sectional view showing a coupled state of the air cushion of FIG. 8 with an outsole and outer surface of a general footgear;

FIG. 10 is a perspective view of FIG. 9; and

Figure 11A:
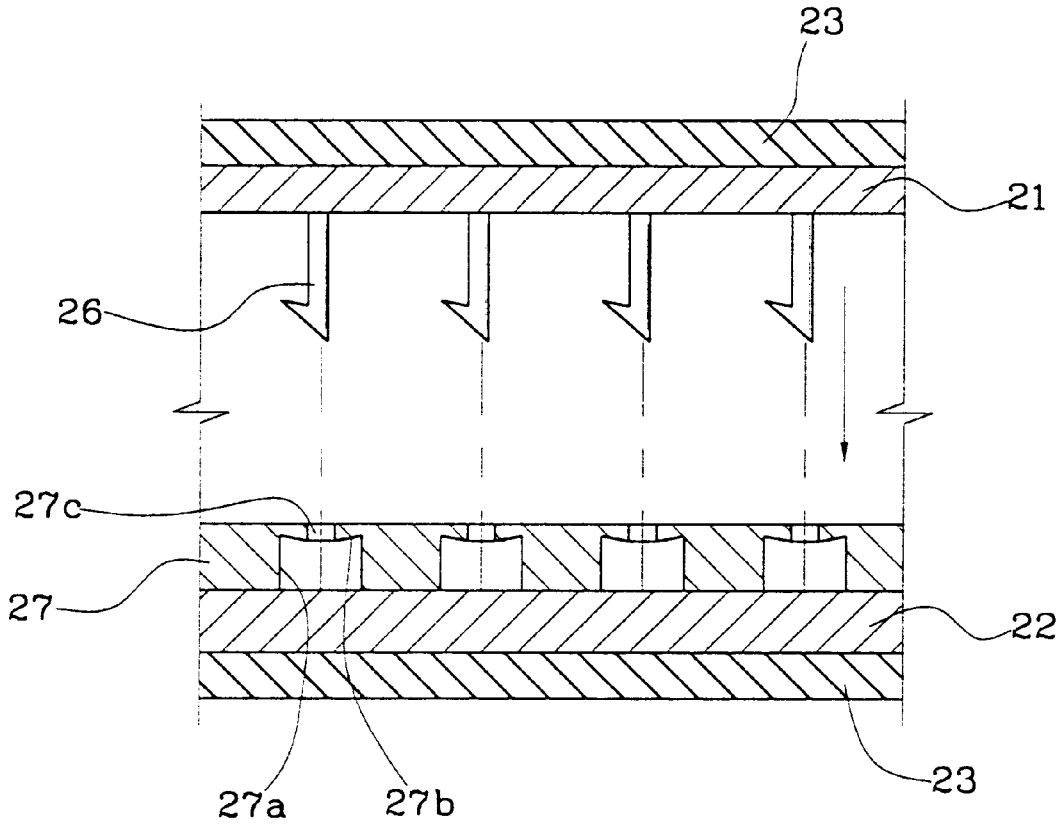
Figure 11B:
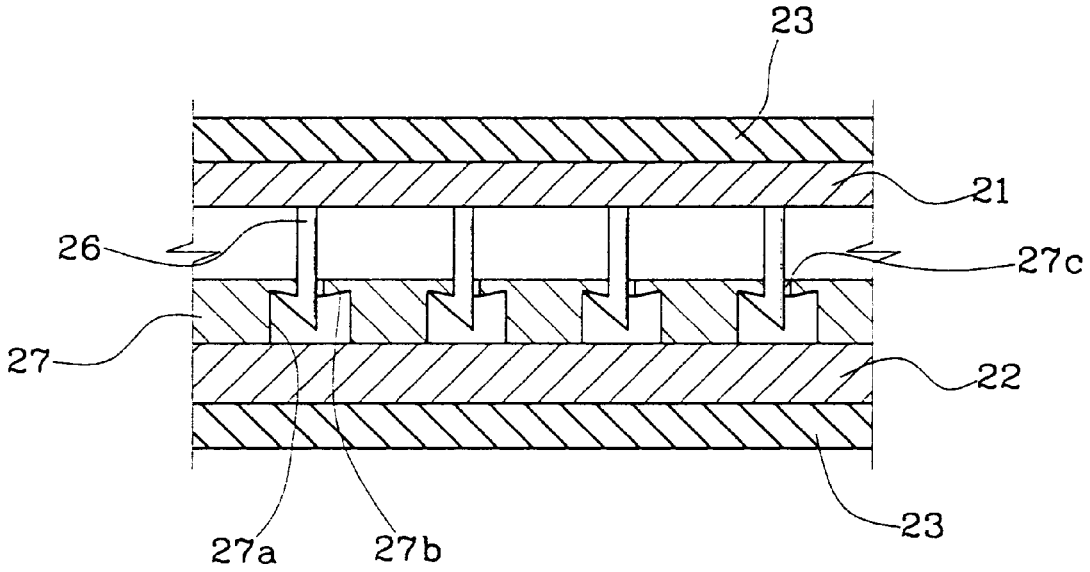

FIGS. 11*a* and 11*b* are side sectional views showing the coupled state of the support pins in the air cushion according to another embodiment of the present invention.

DETAILED DESCRIPTION OF PREFERRED EMBODIMENT

Reference will now be made in detail to the preferred embodiments of the present invention, examples of which are illustrated in the accompanying drawings.

As shown in FIGS. 8 to 10, an air cushion having a support pin structure for shock-absorbing constructed according to an embodiment of the present invention is characterized in that a plurality of support pins are mold by means of a mold in an injection or compression molding manner, thus to have the same height as each other or different height from each other, whereby the curved surface of the air cushion of the present invention corresponds to that of the sole of foot of a human being.

This can solve the problem originated in the conventional air cushion having the support thread structure that as the air cushion has a flat structure, it is applicable only over the predetermined portion of the foot, i.e., a heel, which fails to correspond to the curved surface of the sole of foot.

In more detail, to correspond with the whole sole of foot having a solid curved surface ranged from toes to the vaulted portion and to the heel, an upper plate 21 is formed with a curved surface and a lower plate 22 is formed with a flat surface or a curved surface corresponding to an insole 2 of the footgear. Furthermore, the upper plate 21 and the lower plate 22 are connected to be separated at a predetermined interval by means of a plurality of support pins 24 which are arranged at the same height or different height from each other. This is achieved by molding the plurality of support pins 24, the upper plate 21 including the support pins 24, and the lower plate 22 where a plurality of pin receiving bodies 25 each having a groove are formed to receive the support pins 24 by means of a mold in an injection or compression molding manner. In more detail, the lower plate 22, which is in contact with the top surface of the insole 2 and is flat or curved in accordance with the shape of the insole 2 which is contacted with the ground, is separated at the predetermined interval with the upper plate 21 which is curved along the curved surface of the sole of foot. To charge air into the separated interval between the upper plate 21 and the lower plate 22, the plurality of support pins 24, which are arranged at the same height or different height in a vertical direction in accordance with the height between the upper plate 21 and the lower plate 22, are molded and formed by means of the mold. As a result, the air cushion of the present invention is in close contact with the whole sole of foot, to thereby achieve a desired shock absorbing effect, and the formation of the support pins 24 between the upper plate 21 and the lower plate 22 prevents the generation of the bulging effect. Generally, as the sole of foot takes a three-dimensional shape, the air cushion constructed in accordance with the preferred embodiment of the present invention provides a satisfied buffering effect and a convenient wearing feeling to the user.

The coupling of the support pins 24 of the upper plate 21 and the pin receiving bodies 25 of the lower plate 22 is achieved by covering an adhesive material on the groove formed on each pin receiving body 25 and then inserting and pressurizing each support pin 24 into each groove. The upper plate 21, the lower plate 22, and a cushion body 23 are formed by a thermoplastic synthetic resin, desirably a thermoplastic polyurethane which has an excellent air-tightness. As well known, the polyurethane has a polymeric and compact physical structure and is stable chemically, so nitrogen molecules much contained in air can not be escaped to the outside. Therefore, the polyurethane ensures that the air-tightness can be maintained for a long period of time, even though an external pressure is applied continuously and repeatedly, to thereby exhibit an excellent shock absorbing performance. Specifically, the properties of polyurethane are stable thermally and chemically, so the physical characteristic thereof is not varied for a long period of time. Of course, it should be noted that the air cushion having the support pin structure according to the present invention may be manufactured by using any polymeric material which has the characteristics of thermoplastic, a low permeability, and a high thermal and chemical stability. Most preferably, the upper plate 21, the lower plate 22 and the support pins 24 formed as integrated with the upper plate 21 are colored by an organic dye, an inorganic pigment, a fluorescence, or two or more mixture among them, and are formed on the side surface of the outer surface 3 or the insole 2. The interior of the upper plate 21, the lower plate 22 and the support pins 24 can be seen by means of a known perspective window, to thereby achieve a sophisticated appearance of the footgear. Preferably, in this case, a transparent cushion body 23 is used.

Referring to FIGS. 11*a* and 11*b* showing the coupled state of the support pins with the pin receiving bodies constructed according to another embodiment of the present invention, the support pins 24 are replaced with second support pins 26 each having a hook-shaped end, and the pin receiving bodies 25 are replaced with second pin receiving bodies, each of which has a first cylindrical groove 27*a* and a second cylindrical groove 27*c* to thereby form a pin locking protrusion 27*b*. To manufacture the first cylindrical groove 27*a*, the second cylindrical groove 27*c* and the pin locking protrusion 27*b* by means of a mold, the second pin receiving bodies are firstly formed on a separate pin receiving bodies plate 27 in accordance with the characteristic of the mold which is opened upwardly, and the pin receiving bodies plate 27 is then attached to contact the first cylindrical groove 27*a* with the top surface of the lower plate 22.

The air cushion having the support pin structure according to the preferred embodiments of the present invention includes the upper plate 22 having an averaged curved surface, such that it can be produced in large quantities by introducing the molding by means of the mold. In addition, the air cushion of the present invention is provided by molding the curved surface corresponding to that on the sole of foot of a specific person, to be thereby produced in small quantities in a custom-made production manner. On the other hand, the air cushion having the support pin structure of the present invention can be substituted for a midsole of the footgear, which improves the shock-absorption and has more simplified manufacturing process when compared with the conventional footgear manufacturing process having an air cushion for shock-absorbing.

A method for manufacturing an air cushion having a support pin structure for absorbing shock according to the present invention includes the steps of: molding the upper plate 21 having the plurality of support pins 24 arranged at the same height or different height in a downward direction on the bottom surface thereof by means of a mold in an injection or compression molding manner; molding the lower plate 22 having the plurality of pin receiving bodies 25 on the top surface thereof opposite to the upper plate 21 by means of a mold in the injection or compression molding manner, each of the pin receiving bodies 25 having a groove into which each of the support pins 24 is inserted; coupling the upper plate 21 with the lower plate 22 to receive and fix the support pins 24 into the pin receiving bodies 25; and sealing the coupled upper and lower plates 21 and 22 by means of the cushion body 23 to maintain the air-tightness therein.

The upper plate 21 and the lower plate 22 can be molded by means of the mold in a general injection or compression molding manner. In this case, the present invention is characterized in that the upper plate 21 which includes the plurality of support pins 24 arranged at the same height or different height in a downward direction on the bottom surface thereof and the lower plate 22 which includes the plurality of pin receiving bodies 25 each having a groove into which each of the support pins 24 is inserted, on the top surface thereof opposite to the upper plate 21, are all formed by using each mold. It can be appreciated that the air cushion of the present invention including the upper plate 21 and the lower plate 22 which are formed in the above molding manner introduces a novel technical concept in the air cushion manufacturing process.

Upon completion of the molding, the upper plate 21 and the lower plate 22 are coupled to insert and fix the support pins 24 into the pin receiving bodies 25, such that air is charged to the space between the upper plate 21 and the lower plate 22 and the space is then sealed to thereby act as a shock-absorbing space. Under the coupled state of the upper plate 21 and the lower plate 22, the cushion body 23 surrounds the coupled upper and lower plates to maintain the air-tightness therein, thereby completing the air cushion manufacturing process of the present invention.

As noted above, the support pins 24 of the upper plate 21 can be coupled with the pin receiving bodies 25 of the lower plate 22 by means of an adhesive material. Of course, as shown in FIG. 11*b*, the second support pins 26 each having the hook-shaped end can be coupled with the second pin receiving bodies, in such a manner that the first cylindrical groove 27*a* and the second cylindrical groove 27*c* of the second pin receiving bodies are arranged to form the pin locking protrusion 27*b*, to which the hook-shaped end of the second support pins 26 is locked.

The footgear comprising an air cushion having a support pin structure for absorbing shock according to the present invention replaces the midsole or insole used in the conventional footgear with the air cushion having the support pin structure as mentioned above.

The footgear comprising the air cushion having the support pin structure for absorbing shock is characterized in that the support pin structure includes the upper plate 21 having the plurality of support pins 24 in a downward direction on the bottom surface thereof, the lower plate 22 having the plurality of pin receiving bodies 25 on the top surface thereof opposite to the upper plate 21, each of the pin receiving bodies 25 having a groove into which each of the support pins 24 is inserted, and the cushion body 23 adapted to surround the coupled state of the upper plate 21 with the lower plate 22 where the support pins 24 are received and fixed into the pin receiving bodies 25, thereby maintaining the air-tightness therein, whereby the air cushion having the support pin structure is manufactured to take a shape corresponding to the whole sole of foot like an insole thereof, which is laminated together with an outsole and a midsole and is finally attached to an outer surface. Therefore, the footgear of the present invention is in close contact with the whole sole of foot, to thereby achieve a complete shock absorbing effect, and suppresses the bulging effect, to thereby provide a convenient wearing feeling to the user.

Under the above construction, the air cushion having the support pin structure according to the present invention forms the compressed portion by the shock applied during running or exercise, which causes the interval between the upper plate 21 and the lower plate 22 to be reduced. As a result, the air is collected on the non-compressed portion, in which even upon application of a strong pressure, the coupling state of the upper plate 21 and the lower plate 22 can be well maintained by means of the support pins 25, without any further development of expansion. On the air cushion of the present invention, the non-compressed portion except for the compressed portion is always kept at the flat surface, which removes the generation of bulging effect.

As clearly apparent from the foregoing, an air cushion having a support pin structure constructed in accordance with the preferred embodiments of the present invention can be in close contact with the sole of foot having a solid curved surface, to thereby provide a satisfied buffering effect and a convenient wearing feeling to the user.

Moreover, an air cushion having a support pin structure in accordance with the preferred embodiments of the present invention can be produced in large quantities by means of a standardized mold and in small quantities in a custom-made production manner by molding the curved surface corresponding to that on the sole of foot of a specific person.

On the other hand, an air cushion having a support pin structure in accordance with the preferred embodiments of the present invention can be realized with a method for manufacturing the air cushion of the present invention and furthermore, footgear comprising the air cushion having the support pin structure of the present invention is embodied with such the air cushion of the present invention.

It will be apparent to those skilled in the art that various modifications and variations can be made in an air cushion having a support pin structure for absorbing shock, a method for manufacturing the air cushion, and footgear comprising the air cushion of the present invention without departing from the spirit or scope of the invention. Thus, it is intended that the present invention cover the modifications and variations of this invention provided they come within the scope of the appended claims and their equivalents.

What is claimed is:

1. An air cushion having a support pin structure for absorbing shock, comprising:

an upper plate having a plurality of support pins arranged in a downward direction on the bottom surface thereof;

a lower plate having a plurality of pin receiving bodies on the top surface thereof opposite to said upper plate, each of said pin receiving bodies extending from said top surface toward said upper plate and having a groove into which each of said support pins is inserted such that distal ends of said support pins do not extend beyond said top surface of said lower plate; and a cushion body adapted to surround the coupled state of said upper plate with said lower plate where said support pins are received and fixed into said pin receiving bodies, thereby maintaining the air-tightness therein.

2. The air cushion as defined in claim 1, wherein said upper plate is formed along a curved surface which is in close contact with the sole of a foot.

3. The air cushion as defined in claim 1, wherein said upper plate, said lower plate, and said cushion body are formed by a thermoplastic polyurethane.

4. The air cushion as defined in claim 1 further comprising, said support pins having a hook-shaped end, and said pin receiving bodies having, a first cylindrical portion having a first diameter and an upper distal end, and a second cylindrical portion having a second respectively smaller diameter and a lower distal end engaged against said upper distal end of said first cylindrical portion, wherein the intersection of said lower distal end of said second cylindrical portion and said upper distal end of said first cylindrical portion form a pin locking protrusion to receive and retain said hook shaped ends of said support pins.

5. A method for manufacturing an air cushion having a support pin structure for absorbing shock, comprising the steps of:

molding an upper plate having a plurality of support pins arranged in a downward direction on the bottom surface thereof;

molding a lower plate having a plurality of pin receiving bodies on the top surface thereof opposite to said upper plate, each of said pin receiving bodies extending from said top surface toward the upper plate and having a groove into which each of said support pins is inserted;

coupling said upper plate and lower plate to receive and fix said support pins into said pin receiving bodies such that distal ends of said support pins do not extend beyond said top surface of said lower plate; and sealing the coupled upper and lower plates by means of a cushion body to maintain the air-tightness therein.

6. Footgear having an air cushion, said air cushion comprising:

an upper plate having a plurality of support pins arranged in a downward direction on the bottom surface thereof, a lower plate having a plurality of pin receiving bodies on the top surface thereof opposite to said upper plate, each of said pin receiving bodies extending from said top surface toward said upper plate and having a groove into which each of said support pins is inserted such that distal ends of said support pins do not extend beyond said top surface of said lower plate, and a cushion body adapted to surround the coupled state of said upper plate with said lower plate where said support pins are received and fixed into said pin receiving bodies, thereby maintaining the air-tightness therein.

7. An air cushion of a foot gear for absorbing shock applied to a sole of a foot, the foot gear having a sole portion for supporting the foot and an outer surface portion for surrounding the foot, the sole portion having an outsole and an insole with the air cushion disposed therebetween, the air cushion comprising:

a cushion body having a membrane outer surface and a membrane inner surface defining an air chamber therein;

a first interior plate disposed within the air chamber having a first outer surface fixedly engaged against a side of the membrane inner surface, and a first inner surface having a plurality of support pins extending from the first inner surface toward an interior of the air chamber; and a second interior plate disposed within the air chamber having a second outer surface fixedly engaged against an opposing side of the membrane inner surface, and a second inner surface having a plurality of pin receiving bodies extending from the second inner surface toward the interior of the air chamber, each pin receiving body having a groove into which a distal end of each support pin is fixedly inserted such that the distal ends of the support pins do not extend beyond the second inner surface.

8. The air cushion of claim 7 wherein the support pins further comprise a plurality of predetermined different heights which shape the air cushion to substantially conform to the contour of the sole of the foot.

9. The air cushion of claim 7 further comprising the distal ends of the support pins having a hook shaped end.

10. The air cushion of claim 9 wherein the grooves of the pin receiving bodies further comprise:

a first cylindrical portion having a first diameter and an upper distal end; and a second cylindrical portion having a second respectively smaller diameter and a lower distal end engaged against the upper distal end of the first cylindrical portion;

wherein intersection of the lower distal end of the second cylindrical portion and the upper distal end of the first cylindrical portion form a pin locking protrusion to receive and retain the hook shaped ends of the support pins.

11. A foot gear for absorbing shock applied to a sole of a foot, the foot gear comprising:

an outer surface portion for surrounding the foot; and a sole portion for supporting the foot, the sole portion having an outsole and an insole with an air cushion disposed therebetween, the air cushion including, cushion body having a membrane outer surface and a membrane inner surface defining an air chamber therein, a first interior plate disposed within the air chamber having a first outer surface fixedly engaged against a side of the membrane inner surface, and a first inner surface having a plurality of support pins extending from the first inner surface toward an interior of the air chamber, and a second interior plate disposed within the air chamber having a second outer surface fixedly engaged against an opposing side of the membrane inner surface, and a second inner surface having a plurality of pin receiving bodies extending from the second inner surface toward the interior of the air chamber, each pin receiving body having a groove into which a distal end of each support pin is fixedly inserted such that the distal ends of the support pins do not extend beyond the second inner surface.

12. The foot gear of claim 11 wherein the support pins further comprise a plurality of predetermined different heights which shape the air cushion to substantially conform to the contour of the sole of the foot.

13. The footgear of claim 11 further comprising the distal ends of the support pins having a hook shaped end.

14. The footgear of claim 13 wherein the grooves of the pin receiving bodies further comprise:

a first cylindrical portion having a first diameter and an upper distal end; and a second cylindrical portion having a second respectively smaller diameter and a lower distal end engaged against the upper distal end of the first cylindrical portion;

wherein intersection of the lower distal end of the second cylindrical portion and the upper distal end of the first cylindrical portion form a pin locking protrusion to receive and retain the hook shaped ends of the support pins.

* * * * *